US009114965B2

(12) United States Patent
Reynolds

(10) Patent No.: US 9,114,965 B2
(45) Date of Patent: Aug. 25, 2015

(54) SOCKET DEVICE FOR USE WITH TRAILER JACKS

(71) Applicant: Shannon Smith Reynolds, Ivins, UT (US)

(72) Inventor: Shannon Smith Reynolds, Ivins, UT (US)

( * ) Notice: Subject to any disclaimer, the term of this patent is extended or adjusted under 35 U.S.C. 154(b) by 137 days.

(21) Appl. No.: 13/672,294

(22) Filed: Nov. 8, 2012

(65) Prior Publication Data

US 2013/0119620 A1 May 16, 2013

Related U.S. Application Data

(60) Provisional application No. 61/558,138, filed on Nov. 10, 2011.

(51) Int. Cl.
*B66F 13/00* (2006.01)
*B25B 13/06* (2006.01)

(52) U.S. Cl.
CPC ..... *B66F 13/00* (2013.01); *B25B 13/06* (2013.01); *Y10T 279/3418* (2015.01)

(58) Field of Classification Search
CPC .... B25B 13/06; B25B 13/065; B25B 21/002; B25B 21/007; B25B 21/02; B25F 3/00; B25G 3/26; Y10S 254/03; B66F 13/00; Y10T 279/3418
USPC ..... 81/121.1, 124.2, 176.1, 176.2, 180.1, 81/52; 254/13, 122, 126; 279/143, 145, 279/157; 280/766.1; 411/910
See application file for complete search history.

(56) References Cited

U.S. PATENT DOCUMENTS

| | | | | | |
|---|---|---|---|---|---|
| 2,662,434 | A * | 12/1953 | Burkhardt | 173/93.6 |
| 2,712,254 | A * | 7/1955 | Schodeberg | 173/93.6 |
| 3,490,547 | A * | 1/1970 | Stewart | 173/29 |
| 4,625,599 | A * | 12/1986 | Icard | 81/461 |
| 5,050,467 | A * | 9/1991 | Brown et al. | 81/466 |
| 5,148,724 | A * | 9/1992 | Rexford | 81/60 |
| 5,333,523 | A * | 8/1994 | Palm | 81/177.85 |
| 5,876,526 | A * | 3/1999 | Hamade et al. | 152/416 |
| 5,897,121 | A | 4/1999 | Case | |
| 5,911,437 | A * | 6/1999 | Lawrence | 280/766.1 |
| 5,950,990 | A * | 9/1999 | Castillo | 254/126 |
| 6,010,154 | A * | 1/2000 | Payne et al. | 280/766.1 |
| 6,125,725 | A * | 10/2000 | Fox et al. | 81/177.8 |
| 6,218,746 | B1 * | 4/2001 | Gouge, Jr. | 310/50 |
| 6,237,894 | B1 * | 5/2001 | Cotner et al. | 254/1 |
| 6,354,176 | B1 * | 3/2002 | Nordlin | 81/124.4 |
| 6,526,850 | B1 * | 3/2003 | Miller | 81/177.2 |
| 6,695,289 | B1 * | 2/2004 | Mickael | 254/122 |
| 7,096,765 | B1 * | 8/2006 | Diggle et al. | 81/124.4 |
| 7,841,261 | B2 * | 11/2010 | Milligan et al. | 81/121.1 |
| 8,167,273 | B2 * | 5/2012 | Sjostedt | 254/278 |
| 8,322,764 | B2 * | 12/2012 | Miller et al. | 294/51 |
| 8,590,417 | B1 * | 11/2013 | Bono et al. | 74/545 |
| 2001/0045550 | A1 * | 11/2001 | Reilly et al. | 254/376 |
| 2004/0007101 | A1 * | 1/2004 | Sasaki | 81/121.1 |
| 2005/0109996 | A1 * | 5/2005 | Razzaghi | 254/126 |
| 2006/0097235 | A1 * | 5/2006 | Wu | 254/126 |

(Continued)

*Primary Examiner* — David B Thomas
(74) *Attorney, Agent, or Firm* — Gurr & Brande, PLLC; Robert A. Gurr

(57) ABSTRACT

In an embodiment of the present invention, a socket device comprises a sleeve portion for engaging the rotatable drive-shaft and a socket portion for use with an impact hammer. The sleeve portion further comprises opposing openings to engage a locking mechanism, such as a pin-lock, nut and bolt, cotter pin, or other locking device appreciated by those with skill in the art.

3 Claims, 3 Drawing Sheets

(56) References Cited

U.S. PATENT DOCUMENTS

2006/0196321 A1* 9/2006 Carroll ..... 81/177.2
2009/0151515 A1* 6/2009 Veltri ..... 81/52
2011/0012333 A1* 1/2011 Griffin ..... 280/766.1
2013/0014616 A1* 1/2013 Putsch et al. ..... 81/121.1
2013/0264806 A1* 10/2013 Collins ..... 280/766.1

* cited by examiner

SOCKET DEVICE FOR USE WITH TRAILER JACKS

CROSS-REFERENCE TO RELATED APPLICATIONS

This application claims the benefit of U.S. Provisional Application Ser. No. 61/558,138, filed on Nov. 10, 2011, and is incorporated herein by reference.

BACKGROUND

1. Field of the Invention

The present invention relates to tractor-trailers and the manner in which they are raised and lowered. More particularly, the present invention relates to a socket device attachable to an impact wrench, also known as an impact hammer, so as to raise and lower the jacks of a trailer.

2. The Relevant Technology

The most common way to raise and lower a tractor-trailer (semi-trailer) is by manually actuating the rotatable driveshaft by using a crank arm. This method is very difficult and time-consuming, especially when raising a loaded trailer. This method is also ill-suited for older individuals, those suffering from ailments, or during times of inclement weather. The prior art has attempted to alleviate the problem by using a drill (U.S. Pat. No. 5,897,121), but fails. Standard drills generally do not have sufficient torque, so specialized drills must be used. Furthermore, the chuckable-end portion may loosen under sufficient torque, rendering the socket useless. The present invention seeks to solve these problems.

SUMMARY OF EXAMPLE EMBODIMENTS

In an embodiment of the present invention, a socket device comprises a sleeve portion for engaging the rotatable driveshaft and a socket portion for use with an impact hammer. The sleeve portion further comprises opposing openings to engage a locking mechanism, such as a pin-lock, nut and bolt, cotter pin, or other locking device appreciated by those with skill in the art.

In another embodiment, the socket portion comprises a keyed end. In one embodiment, the keyed end engages an adapter for use with a standard impact hammer. In another embodiment, the keyed end engages a keyed impact hammer.

DETAILED DESCRIPTION OF EXAMPLE EMBODIMENTS

The following descriptions depict only example embodiments of the invention and are not to be considered limiting of its scope.

Figure 1:
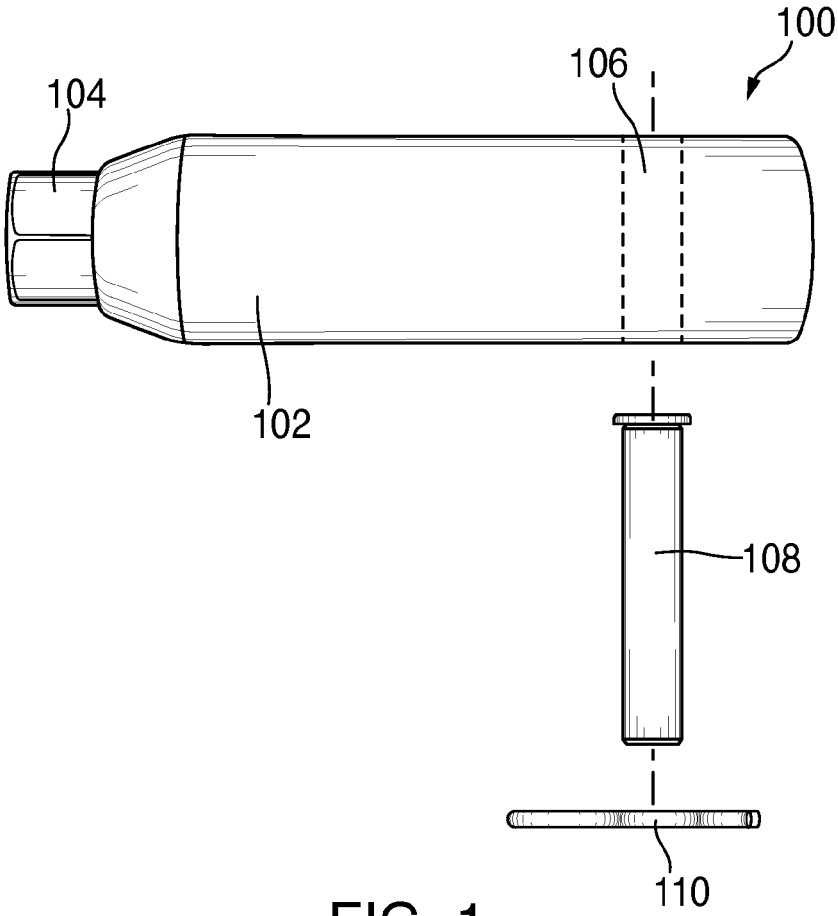
FIG. 1 is a side view of a socket device with the pin-locking mechanism removed

In general, an embodiment of the proposed invention relates to a socket device 100 for use with an impact wrench (not illustrated), also known as an impact hammer, so as to raise and lower the jacks on a trailer. As shown in FIG. 1, a sleeve portion 102 is connected to a socket portion 104. The sleeve portion 102 further comprising a space 106 (defined by opposing openings) to receive the locking pin 108. The locking pin 108 being locked in place with sub-locking pin 110, such as a cotter pin. While the preferred embodiment uses a locking pin 108, it will be appreciated by those with skill in the art that other locking devices, such as a nut and bolt, may be used.

Figure 2:
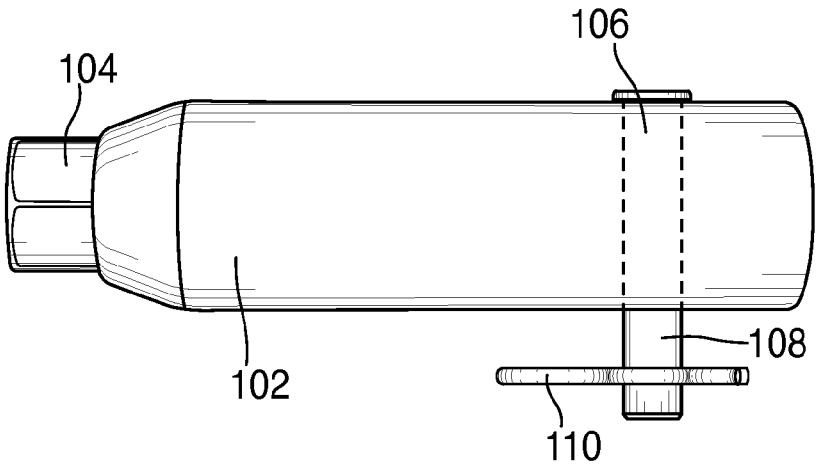
FIG. 2 is a side view of a socket device with the pin-locking mechanism engaged
Figure 3:
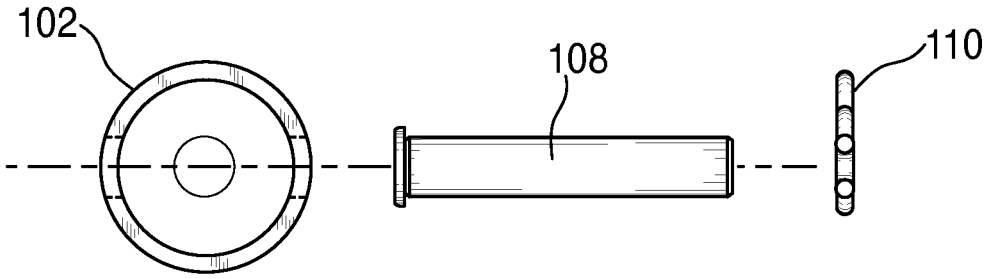
FIG. 3 is a top view of a socket device with the pin-locking mechanism removed
Figure 4:
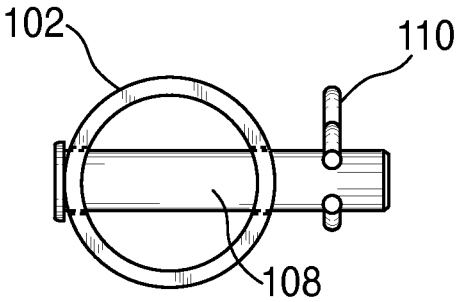
FIG. 4 is a top view of a socket device with the pin-locking mechanism engaged
Figure 5:
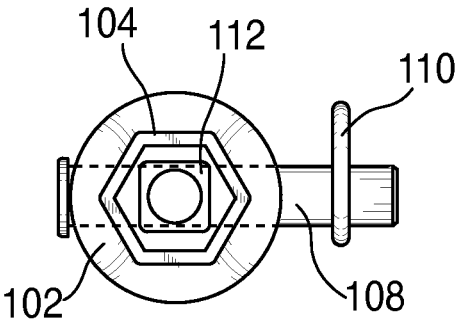
FIG. 5 is a bottom view of a socket device with the pin locking mechanism engaged

The sleeve portion 102 is sized so as to slide over and engage a rotatable driveshaft (not illustrated), and as shown in FIGS. 2-4, is locked into place using locking pin 108. An impact hammer (not illustrated) is received in the socket portion 104 through space 112, as illustrated in FIG. 5. The impact hammer then actuates the rotatable driveshaft, thereby raising or lowering the trailer jacks (not illustrated). Socket device 100 is comprised of materials suitable to withstand the torque required to raise and lower the trailer jacks. By way of example, and in no way limiting, such materials may comprise steel, iron, their derivatives or combinations, or any other material strong enough to withstand the torque required, known to those with skill in the art.

As shown in FIGS. 1,2, and 5, the socket portion 104 may also comprise an outer portion in the shape of a hexagon, or similar, to allow for easy use with other hand-actuated tools.

Figure 6:
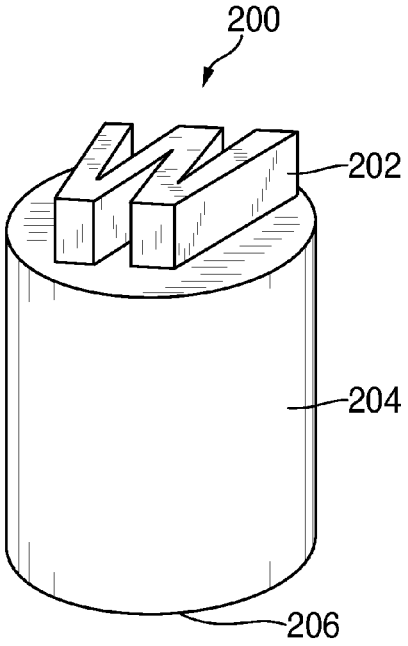
FIG. 6 is a perspective view of a keyed adapter
Figure 7:
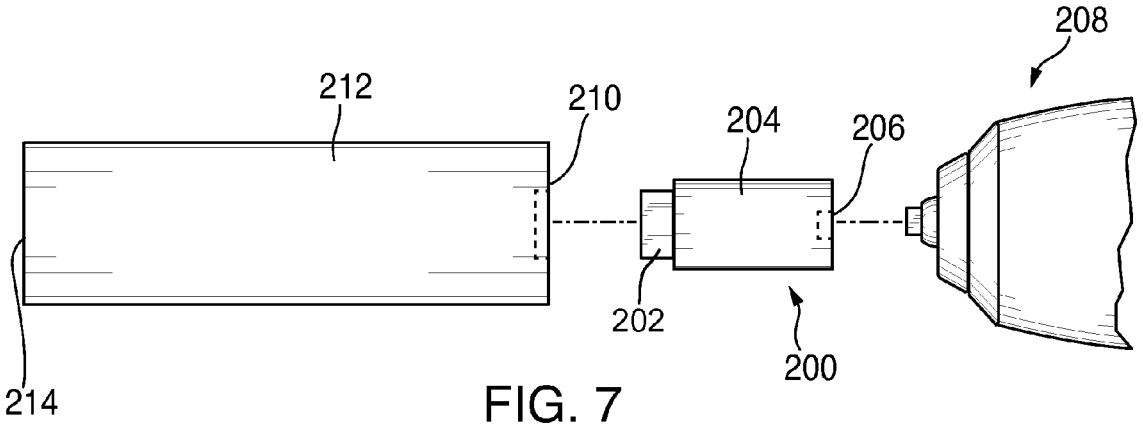
FIG. 7 is a perspective view illustrating a keyed socket, keyed adapter, and impact hammer

As shown in FIG. 6, another embodiment of the present invention comprises a keyed adapter 200. The keyed adapter 200 comprising a keyed portion 202, a shaft 204, and an opening 206 to receive an impact hammer. Keyed portion 202 may take a variety of shapes and sizes, so long as the torque required can be sustained. For example, the keyed portion 202 may comprise letters, such as a "W" for the brand Wal-Mart or an "S" for the brand Swift, or any other shape or size. As more fully illustrated in FIG. 7. A user engages impact hammer 208 with opening 206 of keyed adapter 200. Keyed portion 202 then engages a keyed opening 210 in keyed socket 212. Opening 214 then engages a rotatable driveshaft (not illustrated) to raise and lower trailer jacks.

In another embodiment of the present invention, impact hammer 208 may comprise a keyed portion so as to engage a keyed socket directly without use of a keyed adapter. A keyed socket is useful in preventing theft, as an ordinary impact hammer cannot be used unless one has the adapter.

While the invention has been described with respect to preferred embodiments, it is not to be considered limiting of scope. Thus, the scope of the invention is defined by the appended claims.

What is claimed is:

1. A socket device for use with the rotatable driveshaft of trailer jacks, the socket device comprising:

a sleeve portion with an opening on a first end sized to engage a rotatable driveshaft and a keyed opening on a second end for receiving an impact hammer wherein the keyed opening is in the shape of a W.

2. A socket device for use with the rotatable driveshaft of trailer jacks, the socket device comprising:

a sleeve portion with an opening on a first end sized to engage a rotatable driveshaft and a keyed opening on a second end for receiving an impact hammer wherein the keyed opening is in the shape of an S.

3. A method for raising and lowering trailer jacks, the method comprising:

engaging the rotatable driveshaft of a trailer jack with a socket device;

coupling the socket device with an impact hammer; and raising or lowering the jacks;

wherein the impact hammer comprises a keyed portion and wherein the socket device comprises a sleeve portion with an opening on a first end sized to engage a rotatable driveshaft and a keyed opening on a second end for receiving the keyed portion of the impact hammer and wherein the keyed portion is in alphanumeric shape.

* * * * *